US010231489B2

(12) United States Patent
Crichlow

(10) Patent No.: US 10,231,489 B2
(45) Date of Patent: Mar. 19, 2019

(54) LINGERIE MIMICKING GIFTS OR PRESENTS

(71) Applicant: Shanta N. Crichlow, Smyrna, GA (US)

(72) Inventor: Shanta N. Crichlow, Smyrna, GA (US)

( * ) Notice: Subject to any disclaimer, the term of this patent is extended or adjusted under 35 U.S.C. 154(b) by 111 days.

(21) Appl. No.: 15/352,257

(22) Filed: Nov. 15, 2016

(65) Prior Publication Data

US 2018/0132539 A1 May 17, 2018

(51) Int. Cl.

| | |
|---|---|
| ***A41B 9/04*** | (2006.01) |
| ***A41D 1/14*** | (2006.01) |
| ***A41C 3/00*** | (2006.01) |
| ***A41D 27/08*** | (2006.01) |

(52) U.S. Cl.

CPC ..... *A41B 9/04* (2013.01); *A41C 3/00* (2013.01); *A41D 1/14* (2013.01); *A41D 27/08* (2013.01); *A41B 2300/33* (2013.01)

(58) Field of Classification Search

CPC .... A41B 9/04; A41C 3/00; A41D 1/14; A41D 27/08

USPC ..... 2/211

See application file for complete search history.

(56) References Cited

U.S. PATENT DOCUMENTS

| | | | | |
|---|---|---|---|---|
| 36,125 A | | 8/1862 | Higgins | |
| 285,195 A | | 9/1883 | Wittman | |
| 522,366 A | | 7/1894 | Golding | |
| 746,060 A | | 12/1903 | Frisbie | |
| 746,349 A | | 12/1903 | Mackenzie | |
| 765,555 A | | 7/1904 | Chamberlain | |
| 878,994 A | | 2/1908 | Palmer | |
| 947,891 A | * | 2/1910 | Durichen | A41B 9/04 2/408 |
| 957,360 A | | 5/1910 | Millard | |
| 1,033,235 A | | 7/1912 | Eshborn | |
| 1,083,712 A | | 1/1914 | Uyeda | |
| 1,316,151 A | | 9/1919 | Yleck | |
| 1,470,999 A | | 10/1923 | Morganstern | |
| 1,845,131 A | * | 2/1932 | Curtius | A41B 9/04 2/407 |
| 2,018,782 A | | 10/1935 | Gephart | |
| 2,045,401 A | | 6/1936 | Mowry | |
| 2,062,596 A | | 12/1936 | Monette | |
| 2,170,083 A | | 8/1939 | Kohler | |
| 2,224,684 A | | 12/1940 | Jacobs | |
| 2,377,004 A | | 5/1945 | Hanes | |
| 2,378,826 A | * | 6/1945 | Bissett | A41B 9/04 2/407 |
| 2,417,473 A | * | 3/1947 | Dorfman | A41B 9/04 2/406 |

(Continued)

*Primary Examiner* — Richale Quinn
*Assistant Examiner* — Anne Kozak

(57) ABSTRACT

An undergarment includes an outermost layer comprising a first outer portion and a second outer portion, an innermost layer comprising a first inner portion and a second inner portion, and at least one central layer disposed between the outermost layer and the innermost layer. The outermost layer may include a closed configuration where the first and second outer portions are connected to one another and an open configuration where the first and second outer portions are detached from one another. The innermost layer may include a closed configuration where the first and second inner portions are attached to one another with at least one fastener. In the closed configuration of the outermost layer, the first and second outer portions form a bow.

14 Claims, 6 Drawing Sheets

(56) References Cited

U.S. PATENT DOCUMENTS

| | | | | | |
|---|---|---|---|---|---|
| 2,424,720 | A | | 7/1947 | Stoehr | |
| 2,476,585 | A | | 7/1949 | Cohen | |
| 2,477,353 | A | | 7/1949 | Strait | |
| 2,493,357 | A | | 1/1950 | Miller | |
| 2,522,008 | A | | 9/1950 | Wohlman | |
| 2,532,805 | A | | 12/1950 | Gadalowitz | |
| 2,552,875 | A | | 5/1951 | Stein | |
| 2,597,587 | A | | 5/1952 | Lustgarten | |
| 2,632,177 | A | * | 3/1953 | Bigger | A41B 9/04 2/406 |
| 2,875,763 | A | | 3/1959 | Americo | |
| 2,960,987 | A | | 11/1960 | Rockwell | |
| 3,040,751 | A | | 6/1962 | Mastenbrook | |
| 3,094,990 | A | | 6/1963 | Neilson | |
| 3,224,448 | A | | 12/1965 | Diebold | |
| 3,398,739 | A | | 8/1968 | Marino | |
| 3,449,932 | A | | 6/1969 | Butler | |
| 3,466,667 | A | | 9/1969 | Rosner | |
| 3,498,298 | A | | 3/1970 | Herbener | |
| 3,559,654 | A | | 2/1971 | Pope | |
| 3,712,308 | A | | 1/1973 | Herbener | |
| 4,068,315 | A | | 1/1978 | Rainville | |
| 4,236,257 | A | | 12/1980 | Donaghy | |
| 4,920,769 | A | | 5/1990 | Rickerl | |
| 5,033,121 | A | | 7/1991 | Larsen | |
| 5,060,315 | A | * | 10/1991 | Ewing | A41B 9/005 2/109 |
| 5,086,519 | A | | 2/1992 | Rokasky | |
| 5,315,717 | A | | 5/1994 | Brier | |
| 6,035,439 | A | * | 3/2000 | Chin | A41B 9/08 2/408 |
| 6,216,279 | B1 | * | 4/2001 | Ellingson | A41B 11/001 2/239 |
| 6,374,412 | B1 | * | 4/2002 | Canlas | A41B 9/007 2/67 |
| 6,412,119 | B1 | | 7/2002 | Robles | |
| 6,540,730 | B1 | | 4/2003 | Niedermeyer | |
| 6,560,786 | B2 | | 5/2003 | Lipton | |
| 7,155,940 | B1 | | 1/2007 | Brown | |
| 7,409,729 | B2 | | 8/2008 | Bahm | |
| 7,559,216 | B2 | | 7/2009 | Brown | |
| 7,788,738 | B1 | * | 9/2010 | Haworth | D04D 7/10 2/279 |
| 8,407,817 | B2 | | 4/2013 | Behrens | |
| D726,994 | S | * | 4/2015 | Dehar | D2/712 |
| 9,560,889 | B1 | * | 2/2017 | White | A41D 27/08 |
| 2010/0299811 | A1 | * | 12/2010 | Murata | A41B 9/002 2/403 |
| 2011/0004978 | A1 | * | 1/2011 | Gwaltney | A41B 9/001 2/402 |
| 2012/0060264 | A1 | | 3/2012 | Wilkins | |
| 2013/0104294 | A1 | * | 5/2013 | Edwards | A41B 9/04 2/408 |
| 2014/0041102 | A1 | * | 2/2014 | Gallagher | A41B 9/04 2/406 |
| 2016/0165959 | A1 | * | 6/2016 | Hayes | A41B 9/004 2/67 |

* cited by examiner

LINGERIE MIMICKING GIFTS OR PRESENTS

GENERAL FIELD

Lingerie garments and other intimate apparel items, which may mimic the opening or unwrapping of a gift or present.

BACKGROUND

Undergarments can serve more than just the utilitarian purpose of providing a layer between outer clothes and the wearer's skin. For example, lingerie is often designed to be fashionable, alluring to the wearer and/or potential companion, or confidence-inspiring for the wearer.

SUMMARY

This section is a brief overview of the undergarments of this patent and introduces by way of example some of the concepts that are further described in the Detailed Description section below. It is not intended to identify key or essential features of the patented subject matter, or to otherwise limit the broad scope of this patent in any way.

In one example, an undergarment may include an outermost layer having a first outer portion and a second outer portion; an innermost layer having a first inner portion and a second inner portion; and at least one central layer between the outermost layer and the innermost layer. The outermost layer has a closed configuration where the first and second outer portions are connected to one another and an open configuration where the first and second outer portions are detached from one another; and in the closed configuration, the first and second outer portions form a bow.

According to certain examples, an undergarment includes: an outermost layer comprising a first outer portion and a second outer portion; a first central layer disposed adjacent to the outermost layer; a second central layer disposed adjacent to the first central layer; and an innermost layer disposed adjacent to the second central layer, the innermost layer comprising a first inner portion and a second inner portion, wherein the outermost layer comprises a closed configuration where the first and second outer portions are connected to one another and an open configuration where the first and second outer portions are detached from one another.

According to certain examples, a method of opening an undergarment includes: opening an outermost layer; opening a first central layer disposed adjacent to the outermost layer; opening a second central layer disposed adjacent to the first central layer; and opening an innermost layer to expose a wearer's bare skin.

DETAILED DESCRIPTION

Figure 1:
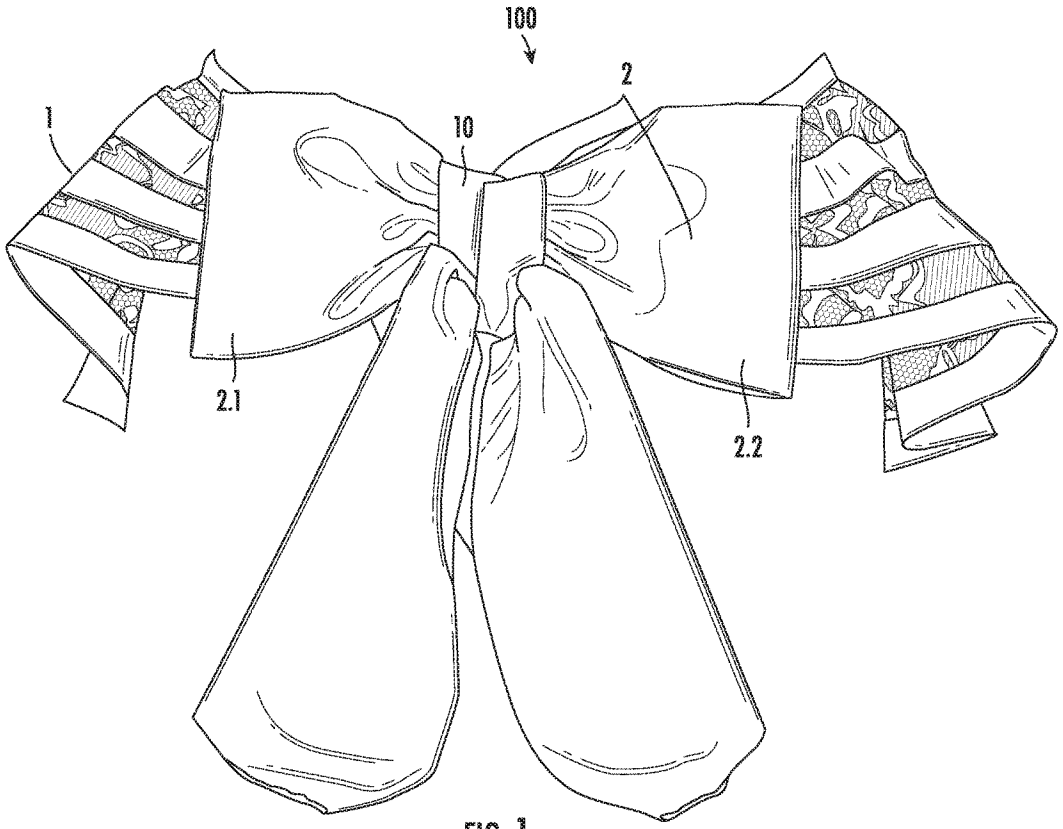
FIG. 1 is a front view of an undergarment in a closed configuration according to certain embodiments of the present invention.

This section is a detailed description of the examples of undergarments shown in the Figures. It is not intended to identify key or essential features of the patented subject matter, or to otherwise limit the broad scope of this patent in any way. The claimed subject matter may be embodied in other ways, may include different elements or steps, and may be used in conjunction with other existing or future technologies.

FIGS. 1-6 illustrate examples of an undergarment 100. Although the figures show underwear, the invention is applicable to underwear, brassieres, and other undergarments. In some examples, the undergarment 100 may include a panty 3, an outermost layer 2, an innermost layer 6, and at least one central layer. In some cases, the undergarment 100 may also include a skirt 1. The skirt 1, in some examples, may be removable from the undergarment 100.

Figure 3:
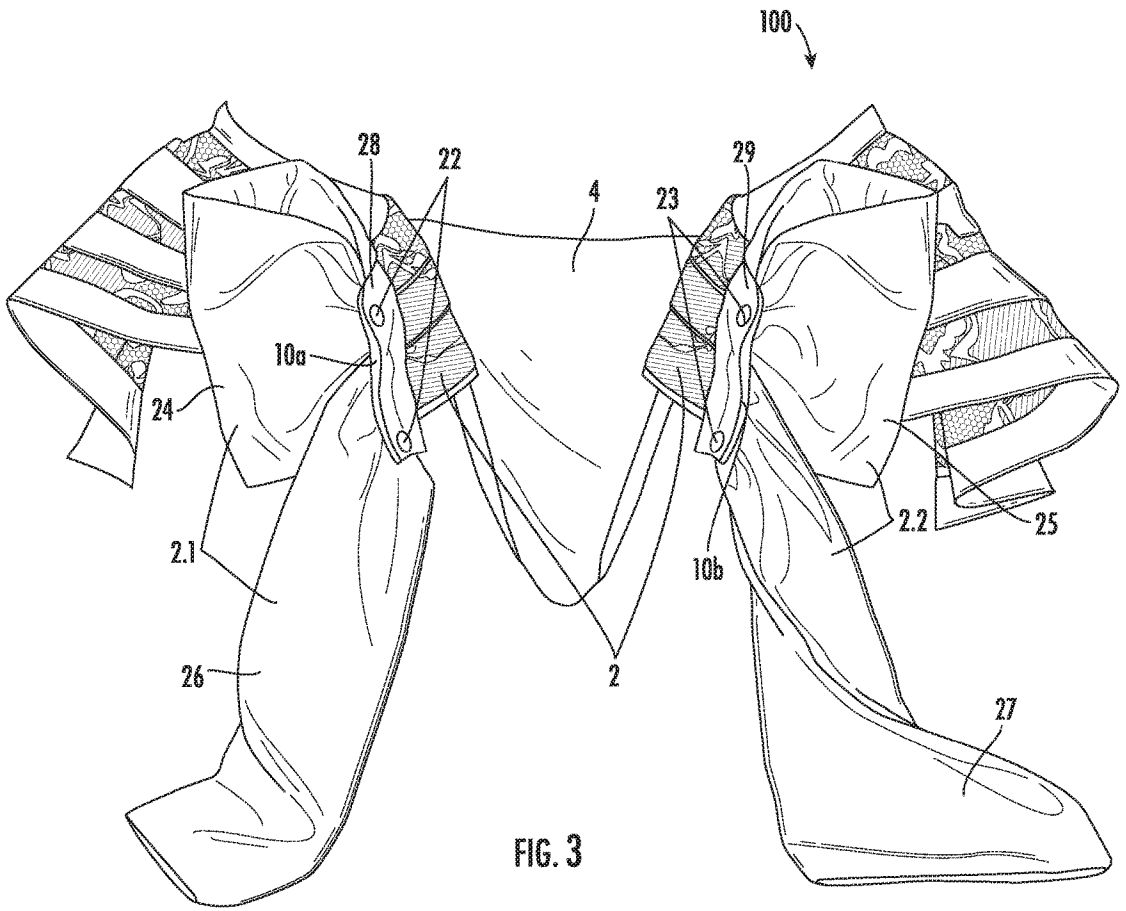
FIG. 3 is a front view of the undergarment of FIG. 1 with an outermost layer decoupled and a first central layer visible.

As shown in FIGS. 1 and 3, the outermost layer 2 of the undergarment 100 may form (among other features) a bow including a first outer portion 2.1, a second outer portion 2.2, and a knot 10. FIG. 1 shows the outermost layer 2 in a closed configuration and FIG. 3 shows the outermost layer 2 in an open configuration. In some examples, the first and second outer portions 2.1 and 2.2 are each lengths of material (such as fabric) that can be tied together to form a bow. The lengths of material may include contour along edges of the material but are not folded or tied into any permanent shape such that the two lengths can be tied to one another in various manners (such as a bow with a single knot 10). Alternatively, in some cases, the first and second outer portions 2.1 and 2.2 each include a pre-formed portion of a bow or a knot (see FIG. 3) that, when joined (in the closed configuration), mimic the appearance of a bow (i.e., no portion of the bow is designed to be untied). In some cases, the first outer portion 2.1 includes (i) a loop portion 24 (permanently formed into a loop shape), (ii) a tail portion 26 that has a first end attached to the first outer portion 2.1 near an attachment of the loop portion 24, (iii) a first knot portion 10*a*, and (iv) a first belt portion 28. In some examples, the second outer portion 2.2 includes (i) a loop portion 25 (permanently formed into a loop shape), (ii) a tail portion 27 that has a first end attached to the second outer portion 2.2 near an attachment of the loop portion 25, (iii) a second knot portion 10*b*, and (iv) a second belt portion 29. In some examples, the first outer portion 2.1 includes one or more fasteners 22 and the second outer portion 2.2 includes one or more fasteners 23. Fasteners 22 and 23 may engage one another to attach first and second outer portions 2.1 and 2.2. In examples where the first and second outer portions 2.1 and 2.2 are each lengths of material tied together to form a bow or a knot, (1) the outermost layer 2 can be formed without any fasteners or (2) the fasteners 22 and 23 can act as supplemental attachment to secure the first and second outer portions 2.1 and 2.2 (i.e., in addition to the bow or knot formed by the first and second outer portions 2.1 and 2.2). The fasteners 22 and 23 may be buttons, snaps, hooks, zippers, rivets, magnets, magnetic paint, hook and loop, or any other appropriate fastener.

Figure 2:
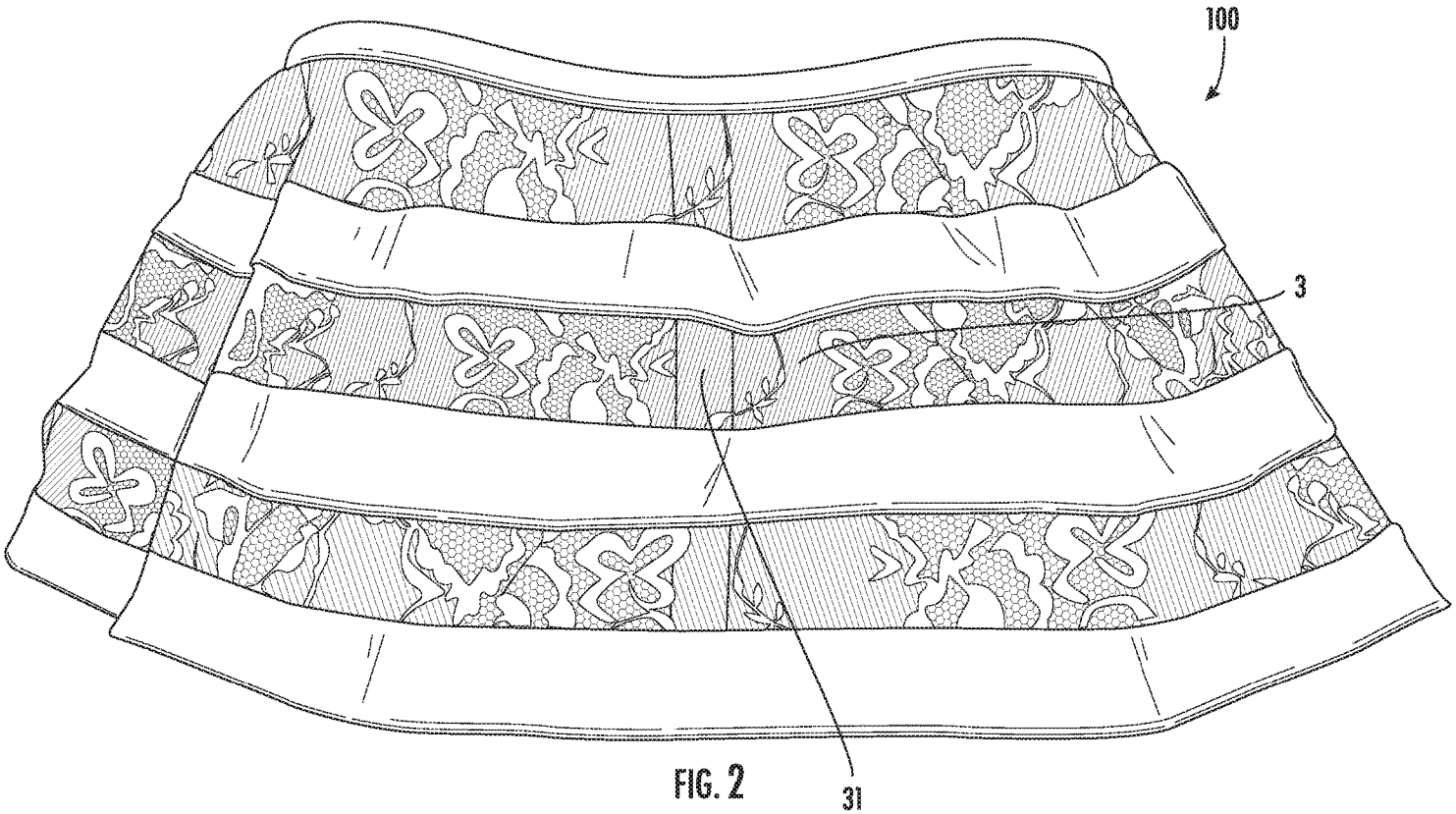
FIG. 2 is a rear view of the undergarment of FIG. 1.

The rear portion 31 of the panty 3, as shown in FIG. 2, may include a thong, T-back, G-string, cheeky, French cut, low cut, full, medium, Brazilian, high-waisted, boy short, hipster, any combination of the aforementioned, or any other appropriate style.

Figure 4:
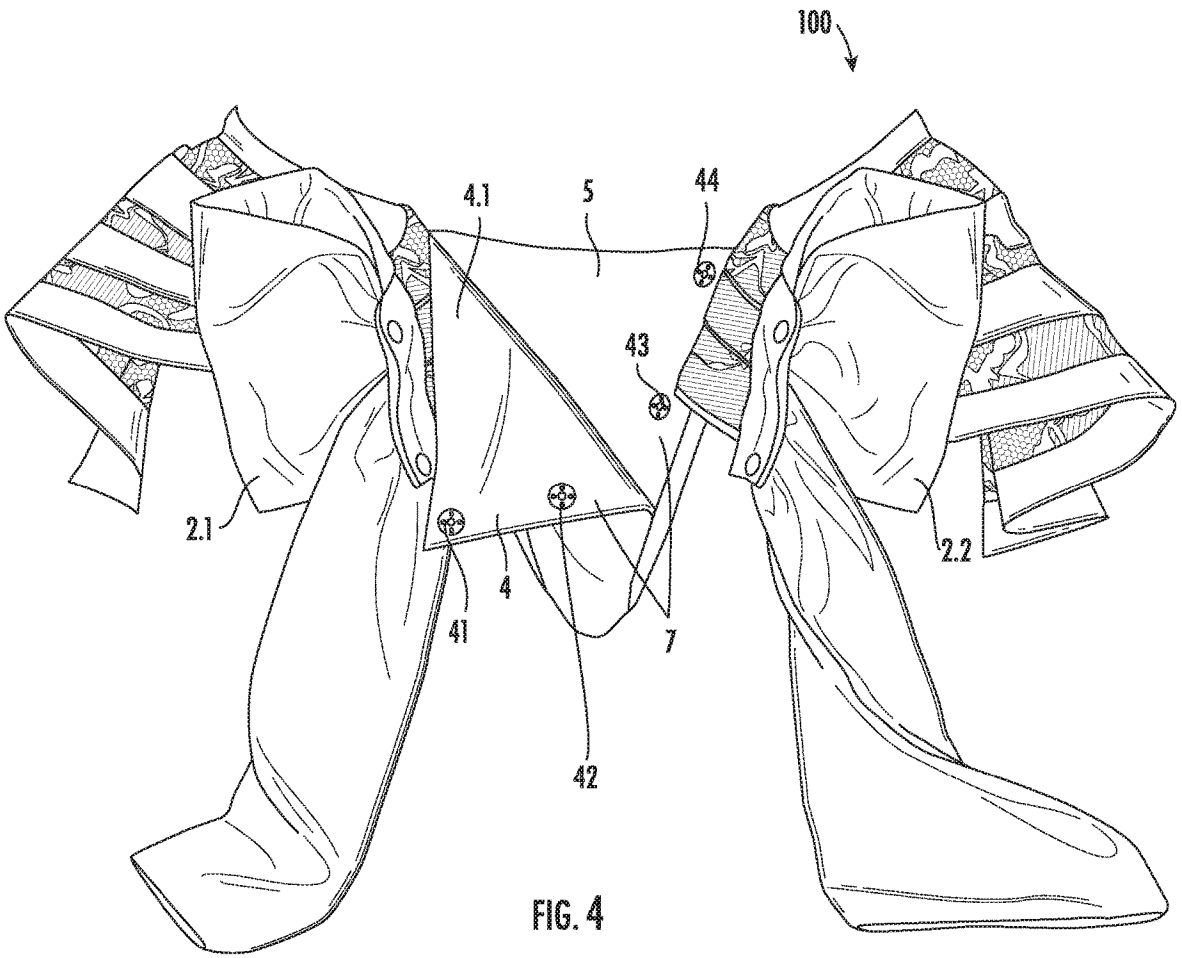
FIG. 4 is a front view of the undergarment of FIG. 1 with an outermost and first central layers decoupled and a second central layer visible.

As shown in FIG. 3, when the outermost layer 2 is in the open configuration, a first central layer 4 (disposed adjacent to the outermost layer 2) is exposed. In some examples, the first central layer 4 is at least partially hidden (in some examples, entirely hidden) when the outermost layer 2 is in the closed configuration. The first central layer 4 may be secured in a closed configuration (see FIG. 3) by one or more fasteners 7 (see FIG. 4). FIG. 4 shows the open configuration of the first central layer 4. The one or more fasteners 7 for securing the first central layer 4 may include, for example, fasteners 41 and 42 located on an inner surface 4.1 of the first central layer 4. The fasteners 41 and 42 may interface with fasteners 43 and 44 located on the second central layer 5. The first central layer 4 may be triangular shape with one or more fasteners arranged along an edge near a wearer's thigh. The fasteners are shown on the right side of the first central layer 4, but the fasteners may be on the left side or any other appropriate location of the first central layer 4.

Figure 5:
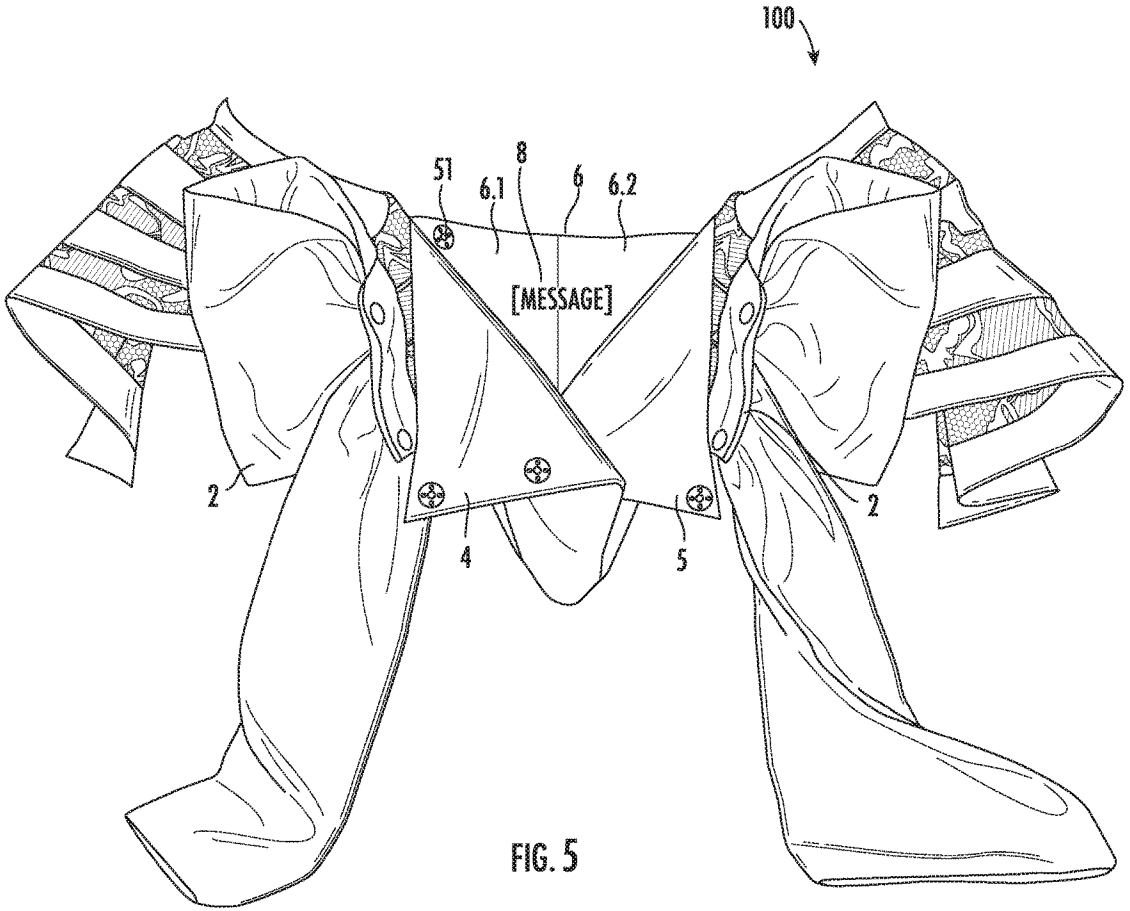
FIG. 5 is a front view of the undergarment of FIG. 1 with an outermost, first central, and second central layers decoupled and an innermost layer visible.
Figure 6:
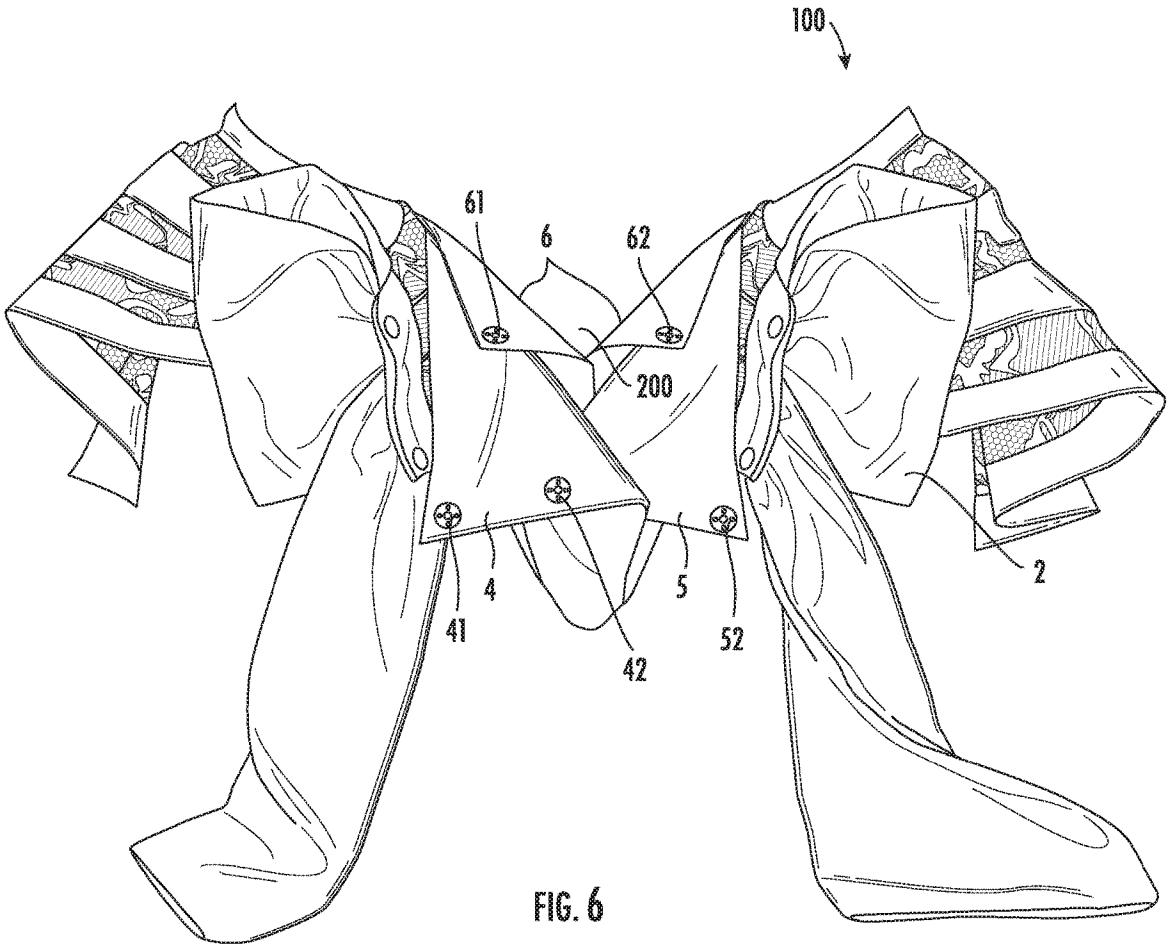
FIG. 6 is a front view of the undergarment of FIG. 1 with an outermost, first central, second central, and innermost layers decoupled.

When the first central layer 4 is in the open configuration (see FIG. 4), a second central layer 5 (disposed adjacent to the first central layer 4) is exposed. In some examples, the second central layer 5 is at least partially hidden (in some examples, entirely hidden) when the first central layer 4 is in the closed configuration. The second central layer 5 may be secured in a closed configuration (see FIG. 4) by one or more fasteners. For example, as shown in FIGS. 5 and 6, the second central layer 5 may be secured by an attachment between a fasteners 51 and 52. As shown in FIG. 5, the fastener 51 may be located on the first inner portion 6.1 of the innermost layer 6. The second central layer 5 may be triangular shape with one or more fasteners arranged along an edge near a wearer's thigh. The one or more fasteners are shown on the left side of the second central layer 5, but the fasteners may be on the right side or any other appropriate location of the second central layer 5.

FIG. 5 shows a closed configuration of the innermost layer 6 (disposed adjacent to the second central layer 5), which is visible when the first and second central layers 4 and 5 are each in their respective open configurations. In some examples, the innermost layer 6 is at least partially hidden (in some examples, entirely hidden) when the second central layer 5 is in the closed configuration. The innermost layer 6 may include a first inner portion 6.1 and a second inner portion 6.2. The first and second inner portions 6.1 and 6.2 may be approximately equal in size (as shown in FIG. 5) or may be different sizes. As shown in FIG. 6, when the first and second inner portions 6.1 and 6.2 are separated from one another, the wearer's bare skin 200 is exposed. In some examples, the innermost layer 6 is secured in a closed configuration (see FIG. 5) by one or more fasteners. For example, as shown in FIG. 6, the innermost layer 6 may be secured by an attachment between fasteners 61 and 62.

In some examples, the innermost layer 6 includes a message 8 that is visible when the one or more central layers are in the open configuration. The message 8 may be written, printed, screened, heat pressed, embroidered, sewn, stitched, painted, glued, or otherwise applied to the innermost layer 6 using ink, gems, thread, rhinestones, glitter, pen, diamonds, crystals, beads, stones, or any other appropriate materials. The message 8 may include any combination of words, symbols, artistic renderings, logos, or any other appropriate expression. For example, the message can include: "I Love You"; "I Miss You"; "I Want You"; "I'm Sorry"; "Surprise!"; "Congratulations!"; "It's a Boy/Girl!"; "Our Wedding Night"; "Happy Anniversary!"; "Happy Birthday!"; "Happy Valentine's Day!"; "Happy Father's Day!"; "Happy Saint Patrick's Day!"; "Just Because"; "Happy Holidays!"; "Merry Christmas!"; "Happy Hanukkah!"; "Happy Kwanza!"; "Happy New Year!".

A method for using the undergarment 100 may include opening the outermost layer 2 (which may include a bow), opening one or more central layers (such as first and second central layers 4 and 5), and opening an innermost layer 6 to expose a wearer's bare skin 200. In some examples, opening a layer (such as the outermost layer 2, the one or more central layers, and/or the innermost layer 6) may include disengaging one or more fasteners. In some examples, opening the outermost layer 2 may include untying a bow and/or disengaging one or more fasteners.

The components of the undergarment may be formed of materials including, but not limited to, fabric, cotton, jersey, nylon, spandex, polyester blended fabric, silk, velvet, leather, crochet, lace, PVC, raffia, fur, latex, mink, neoprene, other fabric materials, or other similar materials. Moreover, the components of the undergarment may be attached to one another via suitable fasteners, which include, but are not limited to, buttons, snaps, hooks, zippers, rivets, magnets, magnetic paint, hook and loop, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

The invention claimed is:

1. An undergarment comprising: underwear comprising an outermost layer comprising a first outer portion and a second outer portion;

an innermost layer comprising a first inner portion and a second inner portion; and at least one central layer disposed between the outermost layer and the innermost layer, wherein:

the outermost layer comprises a closed configuration where the first and second outer portions are connected to one another and an open configuration where the first and second outer portions are detached from one another;

the innermost layer comprises a closed configuration where the first and second inner portions are attached to one another with at least one fastener;

in the closed configuration of the outermost layer, the first and second outer portions form a bow; the first outer portion comprises a first loop portion and a first tail portion of the bow having a first end attached to the first outer portion, a first knot portion, and a first belt portion; the second outer portion comprises a second loop portion and a second tail portion of the bow having a first end attached to the second outer portion, a second knot portion, and a second belt portion; the first loop portion of the first outer portion and the first tail portion of the first outer portion are attached to the first belt portion adjacent one another; the first knot portion is disposed at an end of the first belt portion; the second loop portion of the second outer portion and the second tail portion of the second outer portion are attached to the second belt portion adjacent one another; and the second knot portion is disposed at an end of the second belt portion.

2. The undergarment of claim 1, wherein the outermost layer comprises at least one fastener for attaching the first and second outer portions together in the closed configuration.

3. The undergarment of claim 1, wherein the first and second outer portions each comprise a length of material such that, in the closed configuration, the first and second outer portions are tied to one another.

4. The undergarment of claim 1, further comprising a skirt.

5. The undergarment of claim 1, wherein the at least one central layer comprises a first central layer and a second central layer.

6. The undergarment of claim 5, wherein the first central layer comprises a triangular shape and at least one fastener disposed along an edge of the first central layer.

7. The undergarment of claim 6, wherein the second central layer comprises a triangular shape and at least one fastener disposed along an edge of the second central layer wherein the edge of the second central layer is on an opposite side of the triangular shape from the edge of the first central layer.

8. The undergarment of claim 5, wherein the first central layer is at least partially hidden when the outermost layer is in the closed configuration, the second central layer is at least partially hidden when the first central layer is in a closed configuration, and the innermost layer is at least partially hidden when the second central layer is in a closed configuration.

9. The undergarment of claim 1, wherein the innermost layer comprises a message.

10. An undergarment comprising: underwear comprising an outermost layer comprising a first outer portion and a second outer portion;

a first central layer disposed adjacent to the outermost layer;

a second central layer disposed adjacent to the first central layer;

an innermost layer disposed adjacent to the second central layer, the innermost layer comprising a first inner portion and a second inner portion, wherein the outermost layer comprises a closed configuration where the first and second outer portions are connected to one another and an open configuration where the first and second outer portions are detached from one another; the first outer portion comprises a first loop portion and a first tail portion of a bow having a first end attached to the first outer portion, a first knot portion, and a first belt portion; the second outer portion comprises a second loop portion and a second tail portion of the bow having a first end attached to the second outer portion, a second knot portion, and a second belt portion; the first loop portion of the first outer portion and the first tail portion of the first outer portion are attached to the first belt portion adjacent one another; the first knot portion is disposed at an end of the first belt portion; the second loop portion of the second outer portion and the second tail portion of the second outer portion are attached to the second belt portion adjacent one another; the second knot portion is disposed at an end of the second belt portion; and further comprising a skirt.

11. The undergarment of claim 10, wherein the outermost layer comprises at least one fastener for attaching the first and second outer portions together in the closed configuration.

12. The undergarment of claim 10, wherein the first and second outer portions each comprise a length of material such that, in the closed configuration, the first and second outer portions are tied to one another.

13. The undergarment of claim 10, wherein the first central layer comprises a triangular shape and at least one fastener disposed along an edge of the first central layer.

14. The undergarment of claim 13, wherein the second central layer comprises a triangular shape and at least one fastener disposed along an edge of the second central layer wherein the edge of the second central layer is on an opposite side of the triangular shape from the edge of the first central layer.

* * * * *